United States Patent [19]

Yoshinari

[11] Patent Number: 4,619,241

[45] Date of Patent: Oct. 28, 1986

[54] HIGH-ENERGY IGNITION DEVICE

[75] Inventor: Takashi Yoshinari, Katsuta, Japan

[73] Assignee: Hitachi, Ltd., Tokyo, Japan

[21] Appl. No.: 734,277

[22] PCT Filed: Sep. 7, 1984

[86] PCT No.: PCT/JP84/00429

§ 371 Date: May 9, 1985

§ 102(e) Date: May 9, 1985

[87] PCT Pub. No.: WO85/01323

PCT Pub. Date: Mar. 28, 1985

[30] Foreign Application Priority Data

Sep. 9, 1983 [JP] Japan ..... 58-165175

[51] Int. Cl.[4] ..... F02P 1/00

[52] U.S. Cl. ..... 123/620; 123/618; 123/596; 123/598; 123/605

[58] Field of Search ..... 123/620, 618, 596, 598, 123/605, 626; 315/209 T

[56] References Cited

U.S. PATENT DOCUMENTS

| | | | |
|---|---|---|---|
| 4,136,301 | 1/1979 | Shimojo et al. | 123/620 |
| 4,393,850 | 7/1983 | Nishida et al. | 123/620 |
| 4,402,380 | 7/1983 | Acik | 123/620 |
| 4,409,952 | 10/1983 | Canup | 123/620 |
| 4,433,669 | 2/1984 | Ishikawa et al. | 123/620 |
| 4,448,181 | 5/1984 | Ishikawa et al. | 123/620 |
| 4,455,989 | 6/1984 | Endo et al. | 123/620 |

*Primary Examiner*—Raymond A. Nelli

*Attorney, Agent, or Firm*—Antonelli, Terry & Wands

[57] ABSTRACT

An high-energy ignition device having an igniter coil adapted to produce a high voltage for allowing an electric discharge between electrodes of a sparking plug in accordance with the output from an ignition circuit, and a DC-DC converter adapted to produce a voltage high enough to maintain the electric discharge in the sparking plug. The DC-DC converter is connected such that the output thereof is superposed to the discharge current produced by the igniter coil. The igniter coil and the transformer of the DC-DC converter are integrated with a forming resin. Consequently, the electrical insulation between the parts is improved and the mounting of the ignition device on vehicles is facilitated.

4 Claims, 4 Drawing Figures

HIGH-ENERGY IGNITION DEVICE

BACKGROUND OF THE INVENTION

The present invention relates to an ignition device for internal combustion engines and, more particularly, to a high-energy ignition device in which the output from a DC-DC converter is superposed on the discharge current through a spark plug such as to attain a long duration of the discharge in the spark plug.

An ignition device allows a high voltage discharge between two electrodes of a spark plug so as to ignite a mixture in the engine, thereby triggering an explosive combustion. In order to attain a higher fuel economy and higher output power, it is necessary to effect stable and efficient combustion of the mixture.

A high voltage on the order of 10 to 20 KV is required for breaking the insulation across the electrode gap in the spark plug. However, once the insulation is broken, the discharge can be maintained with only a medium-high voltage of 1 to 2 KV.

In view of this fact, a proposal has been made in which a high voltage pulse, generated by an ignition coil, is initially applied to break the insulation in the spark plug and, after the breakage of the insulation, a medium-high voltage generated by a DC-DC converter is superposed on the discharge current, to thereby maintain the discharge for a longer time. This ignition device, however, requires complicated wiring for connecting three constituent elements: namely an IC igniter, ignition coil and a DC-DC converter. It is quite troublesome to find sufficient room for accommodating these components and wiring in the restricted space of the engine compartment.

An object of the invention is to provide a high-energy ignition device which permits simplification of the wiring and reduces the overall size of the device.

To this end, according to the invention, there is provided a high-energy ignition device in which a spark plug and an output transformer of a DC-DC converter are subjected to an insulation treatment and, after laying electric connection between major portions, the spark plug and the DC-DC converter are integrated with forming resin such as to withstand vibration while maintaining necessary insulation of the spark plug and the output transformer of the DC-DC converter.

DETAILED DESCRIPTION

Figure 1:
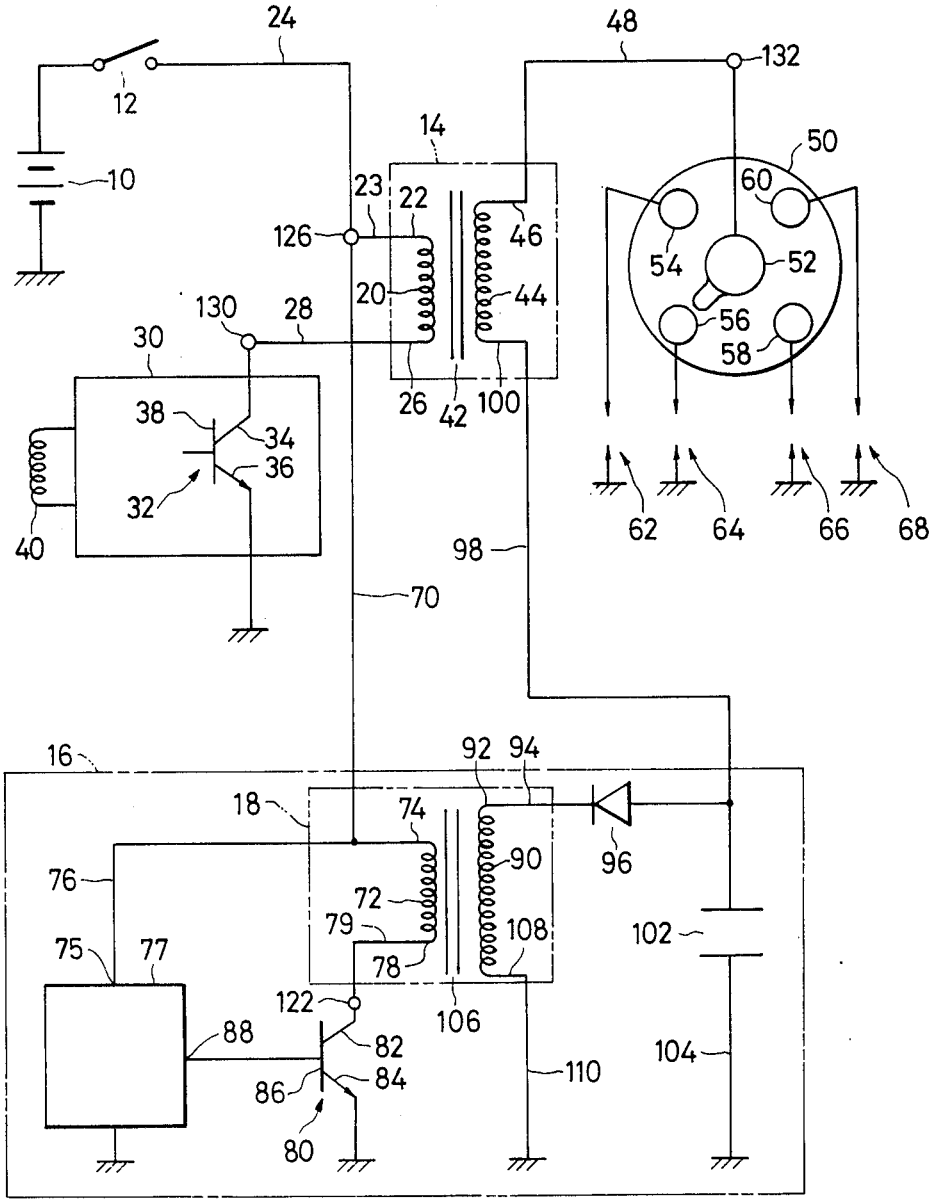
FIG. 1 is a circuit diagram of a high-energy ignition device to which the invention is applied.

Referring now to the drawings wherein like reference numerals are used throughout the various views to designate like parts and, more particularly, to FIG. 1 according to this figure, a circuit of a high energy ignition device includes a battery 10 connected through a key switch 12 to an igniter coil 14 and an output transformer 18 of a DC-DC converter 16. The igniter coil 14 has a primary coil 20, one terminal 22 of which is connected through a line 23 to a line 24 leading to the battery 10, while the other terminal 26 is connected through a line 28 to the collector 34 of a transistor 32 in an ignition circuit 30. The emitter 36 of the transistor 32 is grounded, while the base 38 receives the output signal from a pickup coil 40 which generates a signal synchronous with the engine operation. A circuit connected between the pickup coil 40 and the base of the transistor 32 is well known to those skilled in the art and, therefore, is not described in detail. The transistor 32 is adapted to be turned on and off by the output from the pickup coil 40 in synchronism with the engine operation, thereby interrupting the electric current in the primary coil 20 of the igniter coil 14. A secondary coil 44, magnetically coupled to the primary coil 20 through an iron core 42, is adapted to produce a high-voltage pulse when the current in the primary coil 20 is abruptly interrupted. The secondary coil 44 has a terminal 46 which is connected through a line 48 to the rotor 52 of a distributor 50. The rotor 52 is adapted to rotate in synchronism with the engine operation so as to successively contact the stationary contacts 54, 56, 58 and 60 of the distributor, thus generating sparks in the spark plugs 62, 64, 66 and 68 corresponding to the stationary contacts 54, 56, 58, 60.

One of the terminals 22 of the primary coil 20 is connected through a line 70 to the primary coil 72 of the output transformer 18. The primary coil 72 has a terminal 74 which is connectted through a line 76 to an output terminal 75 of an oscillator 77 adapted to oscillate at a predetermined frequency, and another terminal 78 which is connected through a line 79 to the collector 82 of a transistor 80. The emitter 84 of the transistor 80 is grounded, while the base 86 is connected to the other output terminal 88 of the oscillator 77.

A secondary coil 90 of the output transformer 18 has a terminal 92 which is connected through a line 94 to a diode 96 which in turn is connected through a line 98 to a terminal 100 of the secondary coil of the igniter coil. The plus side of the diode 96 is grounded through a smoothing capacitor 102 and a line 104. The secondary coil 90 is magnetically coupled to the primary coil 72 through an iron core 106, while the other end is grounded through a line 110.

In the circuit arrangement described above, the transistor 32 is turned off by the output voltage of a pickup coil 40 which operates in synchronism with the engine operation, so that the current in the primary coil 20 is decreased abruptly. Consequently, a pulse of a voltage high enough to break the insulation gap in the sparking plug is generated in the secondary coil 44.

The DC-DC converter 16 turns the switching transistor 80 on and off in response to the output signal from the oscillator 77, thus intermittently applying an electric current from the battery 10 to the primary coil 72 of the output transformer 18. The secondary coil 90 of the transformer 18 produces a voltage of about 2 KV which is superposed on the high voltage pulse generated in the secondary coil 44 of the igniter coil 44, through a rectifier circuit consistuted by the diode 96 and the capacitor 102.

The above-mentioned high-voltage pulse is applied to one of the spark plugs 62 to 68 selected by the distributor 50, this breaking the insulation in the spark plug. Once the insulation is broken, the discharge is maintained by the output from the DC-DC converter 16.

With this arrangement, it is possible to obtain a discharge of long duration, thus enabling efficient combustion of the mixture.

Figure 2:
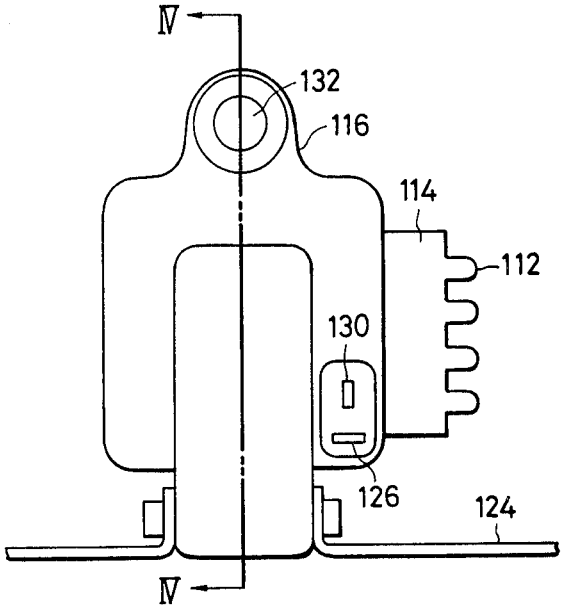
FIG. 2 is a front elevational view of a high-energy igniation device in accordance with the invention.
Figure 3:
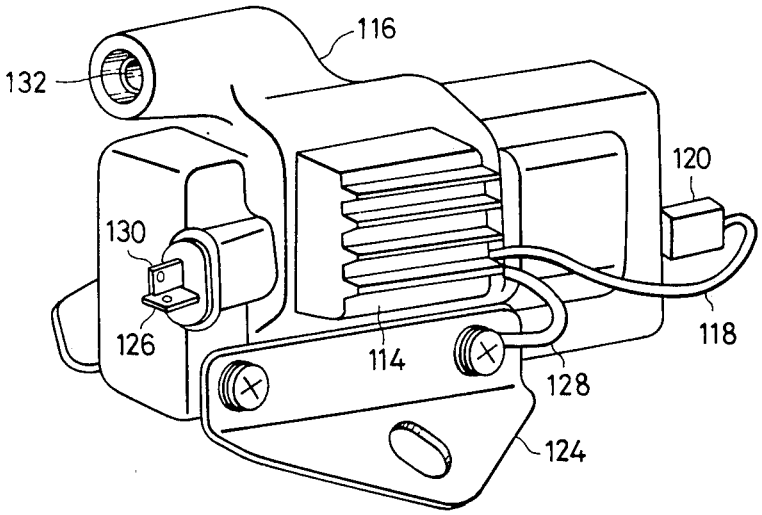
FIG. 3 is a perspective view of a high-energy ignition device in accordance with the invention.
Figure 4:
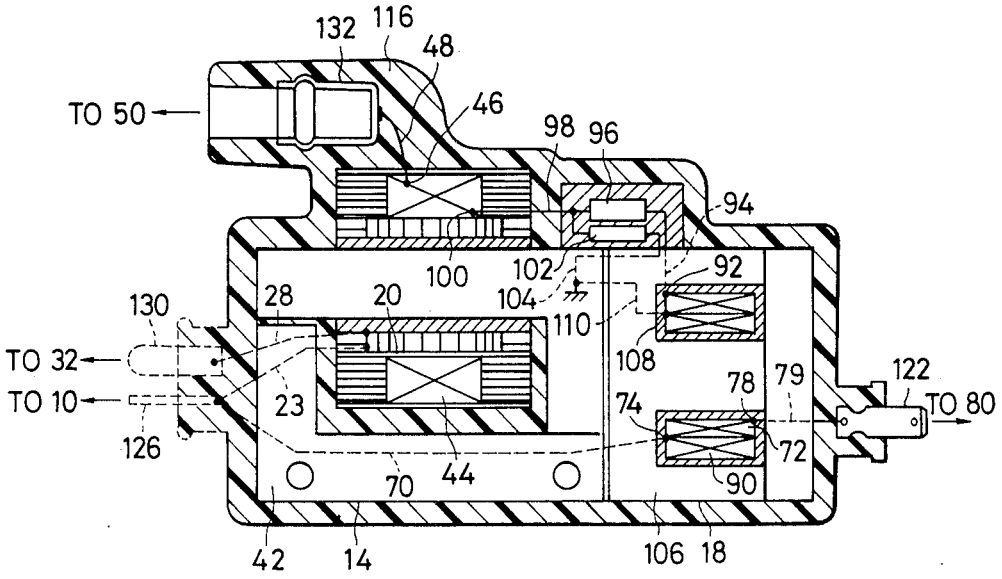
FIG. 4 is a sectional view of the high-energy ignition device of the invention, taken along the line IV—IV of FIG. 2.

The circuit constituents such as the igniter coil 14, output transformer 18, high-voltage diode 96, capacitor 102 and so forth are integrally resin-molded as shown in FIGS. 2 to 4.

The igniter coil is composed of the iron core which is formed by laminating L-shaped silica steel sheets, as well as the primary and secondary coils 20, 44. In order to reduce the size, this coil is constructed as a closed magnetic circuit type igniter coil. The primary coil 20 and the secondary coil 44 are impregnated with an epoxy varnish in a vacuum atmosphere after the coil winding, thus ensuring the insulation (see FIG. 4).

The DC-DC converter 16 has an aluminum case 114 having heat radiating fins 112 accommodating the oscillator 77, the switching transistor 80, the transformer 18, having a ferrite core 106, and the capacitor 102. In order to reduce the size of the DC-DC converter 16, it is necessary to design the oscillator 77 so as to oscillate at a high frequency. In order to minimize the generation of heat in the transformer 18 due to leak of high-frequency current in the primary coil 72, the described embodiment of the invention employs a ferrite having a large magnetic permeability as the iron core 106. The primary coil 72 and the secondary coil 90 are impregnated with an epoxy varnish after the coil winding for perfect insulation (see FIG. 4).

The igniter coil 14 and the transformer 18 thus electrically connected are integrated as they are injected with a forming resin 116. According to the invention, a resin having a good electrical insulation properties and excellent heat resistance and mechanical strength, e.g., PBT reinforced with glass, is preferably used as the forming resin 116.

The aluminum case 114, accommodating the oscillator 77, is fixed to the transformer 18 and also to the igniter coil 14, and the line 118 is connected to a terminal 122 through a connector 120 and is secured by a mounting piece 124 which serves also as a grounding path leading to the chassis.

The power supply for the oscilator 77 in the aluminum case 114 is connected through the line 76 to a power supply terminal 126 on the rear of the case 114. The ground side of the oscillator 77 and of the switching transistor 80 is connected to the mounting piece 124 through a ground path 128. A terminal 130 is connected to the transistor 32 in the ignition circuit.

In the ignition device of the invention having above-described construction, high electrical insulation is ensured and the number of cords leading to the outside is minimized because most of the wiring is fixed in the forming resin. The wiring does not hinder the mounting of the ignition device in the engine compartment, thus facilitating the installation in the vehicle. In addition, the overall size of the ignition device is reduced advantageously.

Electric current of high voltage generated in the igniter coil flows in the lines 98 and 104, so that a code equivalent to the line 48 has to be used for the wiring to these parts and particular care has to be taken to ensure insulation, unless the construction in accordance with the invention is employed. Namely, since the cords 98 and 104 are embedded in a forming resin in the invention, sufficiently strong insulation is ensured and the handling of the device as a whole is facilitated.

Thus, the invention provides a high-energy ignition device which has a strong electrical insulation between parts and which is easy to mount on vehicles.

What is claimed is:

1. A high-energy ignition device for an engine, the high energy ignition device comprising:

a pickup for generating an output synchronous with operations of the engine;

an ignition circuit including a switching device adapted to be turned on and off in accordance with the output from said pickup;

an igniter coil including a primary coil connected to said switching device, a secondary coil in which a high voltage is generated in response to an abrupt turning on and off of electric current in said primary coil, and an iron core between said primary and secondary coils; and a DC-DC converter including a transformer including by a primary coil, a secondary coil and an iron core between said primary and secondary coils, a switching element connected in series to said primary coil, and an oscillator for turning said switching element on and off at a predetermined frequency, said DC-DC converter being adapted to produce, at the output side of said secondary coil, a DC voltage lower than the pulse voltage generated by said igniter coil and adapted to be superposed on the current produced by said igniter coil;

said igniter coil, said output transformer of said DC-DC converter, a first line connected between one end of said secondary coil of said output transformer and ground, a diode having a cathode connected to the other end of said secondary coil of said transformer, a smoothing capacitor one end of which is connected to an anode of said diode, a second line connected between the other end of said capacitor and ground, and a third line connected between said anode of said diode and one end of said secondary coil of said igniter coil, are integrated with a forming resin for facilitating a sufficiently strong insulation.

2. A high-energy ignition device according to claim 1, wherein an aluminum case accommodating said oscillator and said switching transistor is fixed to said igniter coil and said output transformer unit.

3. A high-energy ignition device according to claim 2, wherein said aluminum case is provided with heat radiating fins.

4. A high-energy ignition device comprising:

a pickup for generating an output synchronous with engine operation;

an ignition circuit including a switching device adapted to be turned on and off in accordance with the output from said pickup;

an igniter coil including a primary coil connected to said switching device, a secondary coil in which a high voltage is generated in response to an abrupt turning on and off of electric current in said primary coil, and an iron core between said primary and secondary coils; and a DC-DC converter including a transformer constituted by a primary coil, a secondary coil and an iron core between said primary and secondary coils, a switching element connected in series to said primary coil, and an oscillator for turning said switching element on and off at a predetermined frequency, said DC-DC converter being adapted to produce, at the output side of said secondary coil, a DC voltage lower than the pulse voltage generated by said igniter coil and adapted to be superposed on the current produced by said igniter coil;

said igniter coil and said output transformer of said DC-DC converter, are integrated with a forming resin, wherein lines connecting the secondary coil of said output transformer to the output terminal of said igniter coil are embedded in said forming resin.

* * * * *